US009729964B2

(12) United States Patent
Hogan et al.

(10) Patent No.: US 9,729,964 B2
(45) Date of Patent: Aug. 8, 2017

(54) AUDIO APPARATUS HAVING DYNAMIC GROUND BREAK RESISTANCE

(71) Applicant: Apple Inc., Cupertino, CA (US)

(72) Inventors: Roderick B. Hogan, San Francisco, CA (US); Girault W. Jones, Los Gatos, CA (US); Nathan A. Johanningsmeier, San Jose, CA (US)

(73) Assignee: Apple Inc., Cupertino, CA (US)

( * ) Notice: Subject to any disclaimer, the term of this patent is extended or adjusted under 35 U.S.C. 154(b) by 424 days.

(21) Appl. No.: 14/315,863

(22) Filed: Jun. 26, 2014

(65) Prior Publication Data

US 2015/0382104 A1 Dec. 31, 2015

(51) Int. Cl.
*H04R 3/00* (2006.01)

(52) U.S. Cl.
CPC ..... *H04R 3/00* (2013.01); *H04R 2420/09* (2013.01); *H04R 2499/13* (2013.01)

(58) Field of Classification Search
CPC ..... H04R 3/002
USPC ..... 381/71.7, 74; 710/15
See application file for complete search history.

(56) References Cited

U.S. PATENT DOCUMENTS 4,146,291 A 3/1979 Goff et al.
5,001,440 A 3/1991 Zerod
5,677,959 A 10/1997 Silfvast
5,818,672 A 10/1998 Hilbe
5,832,438 A 11/1998 Bauer
6,417,736 B1 7/2002 Lewyn
6,566,767 B1 5/2003 Tardo
7,366,577 B2 4/2008 DiSanza et al.
7,454,535 B2 11/2008 Hwang et al.
7,579,832 B1 8/2009 Blackburn et al.
7,769,187 B1 8/2010 Farrar et al.
7,932,641 B2 4/2011 Hunter et al.
8,311,765 B2 11/2012 Nielsen et al.
8,340,312 B2 12/2012 Johnson et al.
8,866,547 B2 10/2014 Mathe et al.
8,914,552 B2 * 12/2014 Chadbourne ..... G06F 13/102 710/15
2002/0001381 A1 1/2002 Mori
2002/0036913 A1 3/2002 Suzuki et al.
2011/0012667 A1 1/2011 Yamkovoy
2011/0128019 A1 6/2011 Saito
(Continued)

OTHER PUBLICATIONS

Non-Final Office Action (dated Sep. 22, 2014), U.S. Appl. No. 13/630,202, filed Sep. 28, 2012, First Named Inventor: David C. Breece, III, (12 pages).

(Continued)

*Primary Examiner* — Md S Elahee
(74) *Attorney, Agent, or Firm* — Blakely, Sokoloff Taylor & Zafman LLP

(57) ABSTRACT

A method for audio signal processing, where an audio amplifier drives a load through a connector, using 1) an input audio signal, and 2) a signal from a return pin of the connector. Output headroom of the audio amplifier is automatically detected, while the amplifier is driving the load. A variable resistor circuit that is coupled to provide variable resistance between the return pin of the connector and a ground plane, is automatically adjusted, in response to the detected output headroom of the amplifier. Other embodiments are also described and claimed.

20 Claims, 10 Drawing Sheets

(56) References Cited

U.S. PATENT DOCUMENTS

| | | | |
|---|---|---|---|
| 2011/0268289 | A1 | 11/2011 | Baranwal et al. |
| 2014/0093103 | A1 | 4/2014 | Breece, III et al. |

OTHER PUBLICATIONS

"Autonomous Audio Headset Switch", Check for Samples: TS3A225E, Copyright 2011 Texas Instruments Incorporated, SCDS329—Nov. 2011, www.it.com, (1 page).
"Low-Power Audio CODEC wit DirectDrive Headphone Amplifiers", MAX9856, Maxim Integrated Products, Product Information, 19-1288; Rev. 1; Sep. 2008, (pp. 1-46).
"Low-Power Audio CODEC with DirectDrive Headphone Amplifiers", MAX9856, Maxim Integrated Products, Product Information, 19-1288; Rev 2; Dec. 2011, (pp. 1-46).
"Multi-Channel High Definition Audio CODEC", WM8860, Wolfson® Microelectronics, Product Brief, Apr. 2011, Rev. 3.1, (pp. 1-24).
Crump, Stephen, "Ground Loop Break Circuits and Their Operation", Application Report, SLOA143—Oct. 2009, Audio Products, copyright 2009 Texas Instruments Incorporated, (pp. 1-14).
Mitchell, Peter W., et al., "A Musically Appropriate Dynamic Headroom Test for Power Amplifiers", *AES, An Audio Engineering Society Reprint*, Presented at the 83rd Convention Oct. 16-19, 1987 New York, (Oct. 16-19, 1987), 9.

* cited by examiner

AUDIO APPARATUS HAVING DYNAMIC GROUND BREAK RESISTANCE

An embodiment of the invention is related to techniques for reducing ground loop-induced interference or noise in audio devices. Other embodiments are also described.

BACKGROUND

An audio source device (e.g., a laptop computer, a tablet computer, or a smartphone) can be connected through an audio cable to an audio receiver (e.g., a powered loudspeaker, a television unit, or an audio amplifier connected to a speaker), to convert an audio signal into sound. Quite often, an appreciable difference in the ground potential of the two devices can arise during operation, typically due to the presence of a ground loop that connects the "ground planes" of the two devices to each other, e.g. through an ac wall plug, or through a grounded communications cable. This ground potential difference voltage may be modeled by a voltage source referred to as Vn. The voltage Vn causes a current through the small-but-finite-resistance of a ground wire of the audio cable, which in turn interferes with the audio signal at the receiver. This interference is often manifested as a buzz or hum that can be heard, along with the desired content in the audio signal, from a speaker that is connected to the receiver.

Audio interference due to a ground loop may be ameliorated, by using an audio cable that has a very low resistance ground wire. Such cables however are often deemed to be too bulky. Another way to reduce the effect of the ground loop is to insert a sufficiently large "ground loop break" resistance Rgb in series between a ground pin of the audio connector in the source device and the system ground of the source device. This reduces the resulting voltage drop across the cable ground wire thereby reducing the resulting interference. But making Rgb too large may cause undesirable crosstalk between left and right channels that are being carried by the audio cable, when driving certain low impedance loads such as headsets.

SUMMARY

In some cases, when Rgb is made too large, a further problem is created, namely that the amplifier can run out of headroom, i.e. its output voltage amplitude becomes so large as to reach close to the voltage of one of the power supply rails that are feeding the amplifier. This can occur when the amplifier has a feedback input that is coupled to receive the voltage of the connector's return pin, and coupling Rgb to this feedback input results in a voltage divider being formed by series-coupled resistances of the external load and Rgb, between the amplifier's output and the amplifier's ground reference node. In this feedback scenario, increasing Rgb will lead to more of the available amplifier output voltage swing being dropped across Rgb, for a given amplifier input voltage, which in turn will feed back to the amplifier thereby causing the amplifier to respond by increasing its output voltage (so as to compensate for the larger drop across Rgb). Continued increase of the amplifier output voltage in this manner will lead to distortion of the voltage waveform produced across the external load (which includes the speaker driver), and eventually clipping of the amplifier output voltage. This undesirable effect is more likely to occur when the input impedance of the coupled external audio device is not large enough in comparison to Rgb.

An embodiment of the invention is an audio source apparatus that automatically adjusts the value of Rgb upward, during in-the-field use by its end user, in order to reduce ground loop interference when coupled to higher impedance external audio loads such as a home audio receiver or an ac wall powered external speaker. This increase however is limited, to also reduce the likelihood of distortion occurring in the amplifier output signal (due to too much signal swing).

In one embodiment, the audio amplifier has a first input coupled to an audio source to receive an input audio signal containing user audio content, a second input coupled to the return pin of a connector to obtain a feedback signal, and an output that is coupled to a signal out pin of the connector. The audio amplifier may have a ground reference node that is coupled to a ground plane of the apparatus. An amplifier headroom detector detects headroom of the audio amplifier. A dynamic ground break resistance controller has an input coupled to an output of the headroom detector. The controller is coupled to dynamically control the variable resistor circuit in response to the headroom detection, i.e. automatically during in-the-field use of the apparatus by its end-user. In this manner, when a higher impedance external load is connected, a larger value of Rgb is selected that will reduce ground loop interference but without being so large as to cause the amplifier output to run out of signal swing. When a lower impedance external load, such as a passive speaker, is connected, Rgb is reduced, as needed to maintain sufficient signal swing across the external load. Also, this approach may automatically make adjustments to Rgb (in order to help reduce ground loop interference) during the lifetime of the audio apparatus, as parasitic resistance such as connector contact resistance changes during the lifetime of the audio apparatus, due to age and usage, or when different audio cables having different cable resistance are used. In one embodiment, the headroom detection is sensitive enough to detect changes in the headroom that are caused by the relatively smaller changes in the parasitic resistance, allowing easy updates to select the appropriate value of Rgb.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, in the interest of conciseness, a given figure may be used to illustrate the features of more than one embodiment of the invention, or more than one species of the invention, and not all elements in the figure may be required for a given embodiment species.

DETAILED DESCRIPTION

Several embodiments of the invention with reference to the appended drawings are now explained. Whenever the relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

Figure 1A:
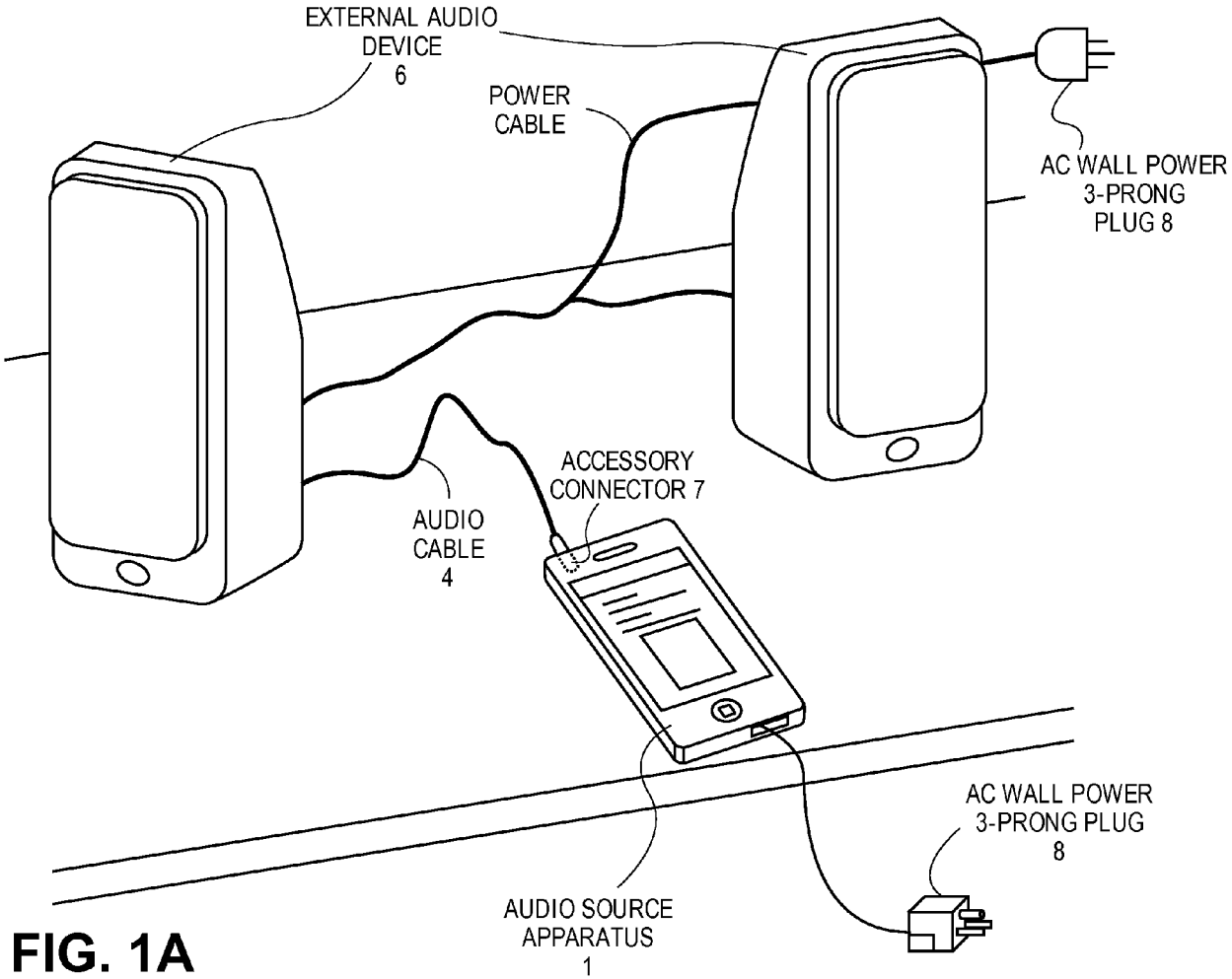
FIG. 1A illustrates an audio system having a wall-powered audio source device that is connected via an audio cable to a wall-powered speaker unit.

FIG. 1A illustrates an audio system having an audio source apparatus 1 that is connected to ac wall power through a 3-prong plug, and to an external audio device 6 via an audio cable 4. The external audio device 6 in this example is a wall-powered speaker unit. In this case, a smartphone is shown that is connected to ac wall power through a 3-prong plug 8 that also has an attached ac power adapter. As mentioned below, other combinations for the audio source apparatus 1 and the external audio device 6 are possible.

Figure 1B:
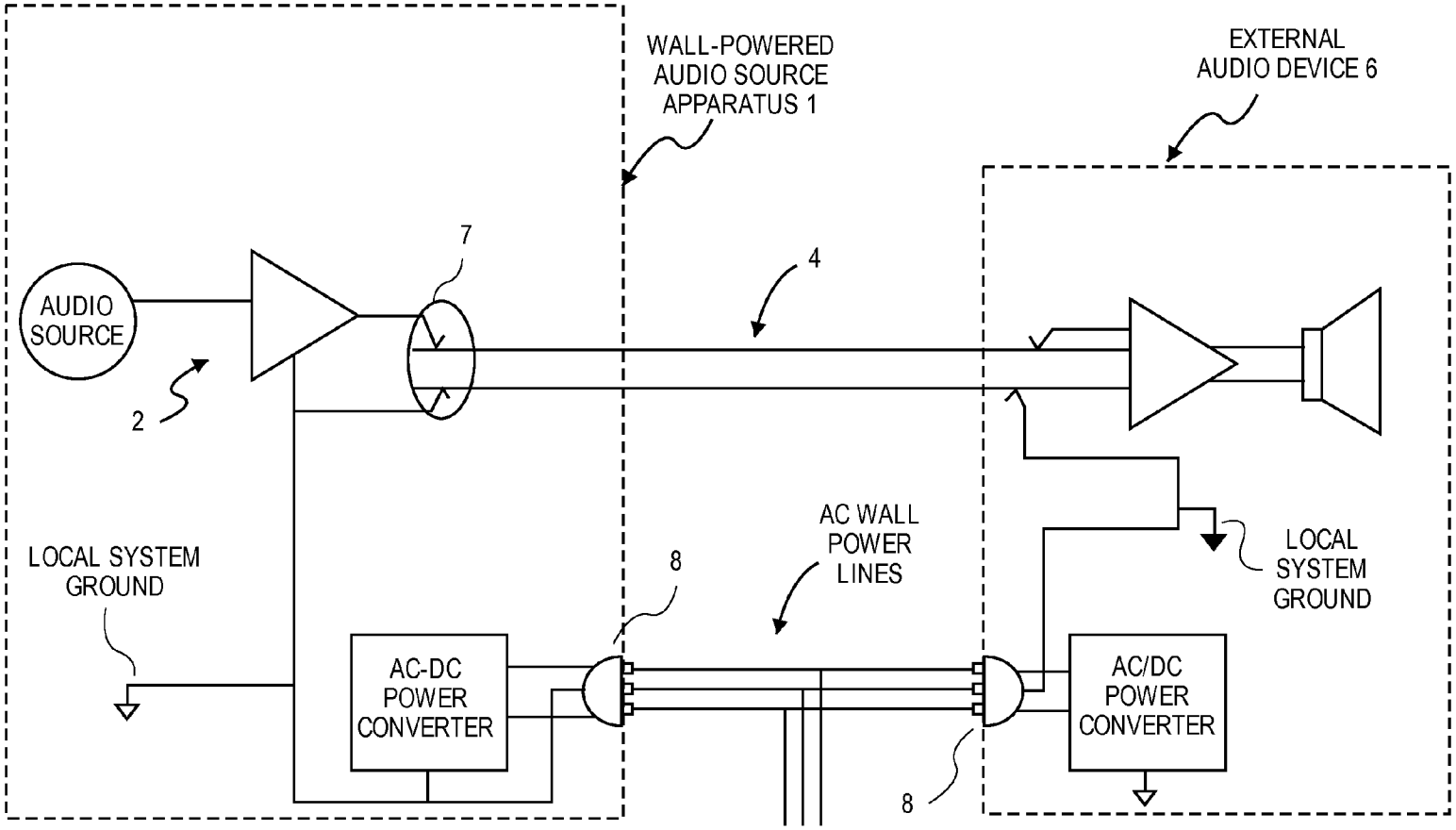
FIG. 1B is a combined block diagram and circuit schematic of relevant parts of the system of FIG. 1A, illustrating a ground loop.

The audio source apparatus 1 may be a desktop computer, a laptop or notebook computer, a tablet computer, or other consumer electronics audio device that contains an audio source. FIG. 1B is a combined block diagram and circuit schematic of relevant parts of the system of FIG. 1A. The system may be designed to play a wide range of digital items, including music files, movie files, and streaming Internet content. In addition, the audio source may also be for a telephony application, where a downlink audio signal (containing speech of a far-end user during a voice or video call) is fed through the audio cable 4.

Figure 7:
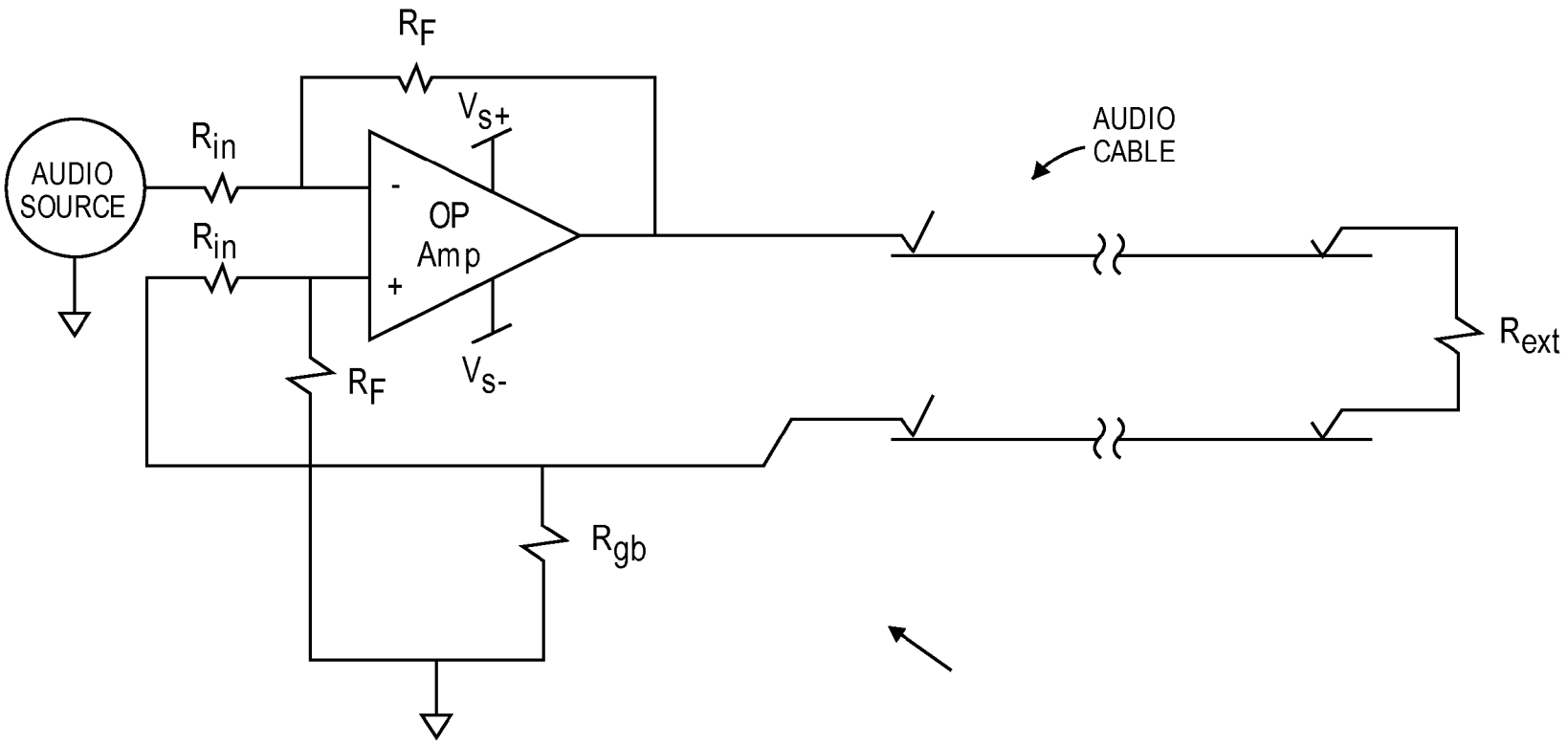
FIG. 7 is a circuit schematic of an audio amplifier connected to an external load and a variable ground break resistor circuit.

Still referring to FIG. 1B, the audio source may include a digital audio processor (a programmed processor, e.g. a programmed special purpose processor) and a digital-to-analog converter whose input is coupled to the output of the digital audio processor (not shown). The audio source can produce an audio signal by converting any digital audio signal into analog form. The digital-to-analog converter has an output that is coupled to the signal input of an amplifier 2. This signal input may be a differential input, where the amplifier 2 would in that case be, for example, a differential input to single ended output amplifier, or the input may be single ended as well. Any suitable audio amplifier design may be used for the amplifier 2, including, for example, an op-amp based design as depicted in FIG. 7, but also a switching type or pulse width modulation (Class D) type. In the case of the latter, a separate digital-to-analog converter may not be needed as part of the audio source, because a Class D amplifier can accept a digital PWM audio signal.

An output node of the amplifier 2 is coupled to the external audio device 6 through a signal out pin of an audio connector 7. The connector 7 also has a signal return pin, in addition to the signal out pin as shown. The signal return pin is directly coupled to a ground plane of the source apparatus 1. The amplifier 2 may also be directly coupled to the ground plane of the apparatus, through any one of several possible techniques (to be described below). It should be noted that while a single audio channel is shown in FIG. 1B, the description here is also applicable to a connector 7 and audio cable 4 that can support multiple analog audio out channels in parallel, where a return pin of the connector may be shared by two or more channels. In addition, the connector 7 may also support one or more audio in channels, e.g. via a microphone or signal in pin. The connector 7 may also carry other general-purpose data or communication signals (in addition to analog audio signals). In one embodiment, the connector 7 may be, for example, a 3.5 mm tip, ring, ring, sleeve (TRRS) or a headphone plug type of connector, or it may be an RCA type connector, or other suitable connector having at least one signal out pin and a signal return pin. Note that there may or may not be a separate connector within the external audio device 6 (at the end of the audio cable 4 opposite that of the connector 7).

The external audio device 6 serves to convert the audio signal received over the audio cable 4 into sound, through an acoustic transducer or speaker (not shown). As depicted in the example of FIG. 1A, the external audio device 6 may be a self-powered or ac wall-powered speaker unit that is coupled via a separate power cable and 3-prong plug 8 to an ac wall power outlet (not shown). Of course, this is only an example—the external audio device 6 may be another type of sound producing apparatus such as a television monitor with a built in speaker (see FIG. 2A) or a home entertainment audio system receiver/power amplifier that is connected to external speakers.

Figure 3:
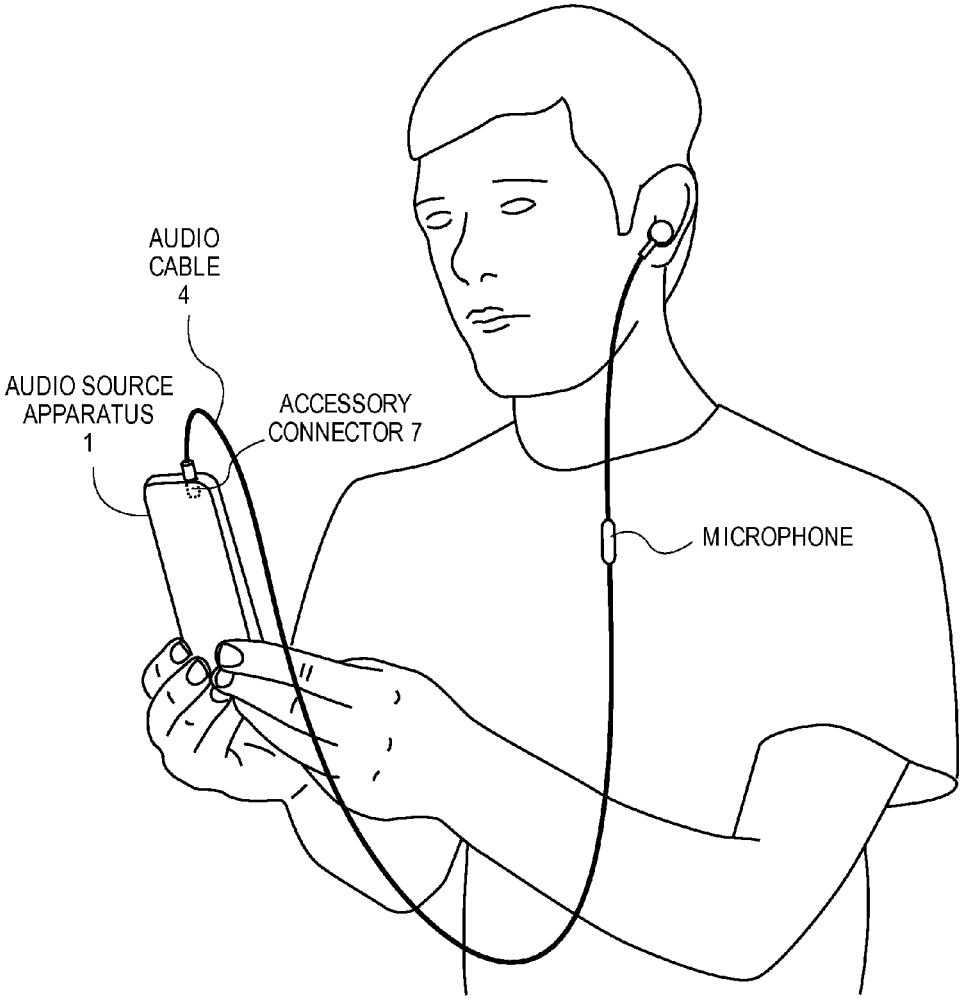
FIG. 3 illustrates yet another audio system having an audio source device that is connected to a wired headset, with essentially no ground loop.

Still referring to FIG. 1B, the amplifier 2 may be capable of driving a variety of different external audio loads, including low impedance loads such as an unpowered headset or earphone speaker (see FIG. 3), but also higher impedance loads such as the receiver input amplifier depicted in FIG. 1B, also referred to as a line in amplifier of a home entertainment receiver, a vehicle entertainment receiver, or a powered speaker unit.

As seen in FIG. 1A and FIG. 1B, the audio source apparatus 1 and the external audio device 6 have local system grounds that are connected to each other not just through the audio cable 4 but also by a low impedance path through another cable. In FIG. 1B, this additional cable encompasses ac power lines that may be within the wall of a residence or business, and where these ac power lines connect, for example, the ac wall power outlets to which respective 3-prong connectors 8 of the source apparatus 1 and external audio device 6 are connected. This causes the creation of a ground loop, which develops an interference voltage Vn (modeled as a voltage source Vn) between the ground nodes as shown, which causes an interfering current that is in the audible frequency range to be induced in the finite resistance of the audio cable 4, thereby causing audible interference to be combined with the desired user audio content, both of which will be heard through the speaker of the external audio device 6.

Figure 2A:
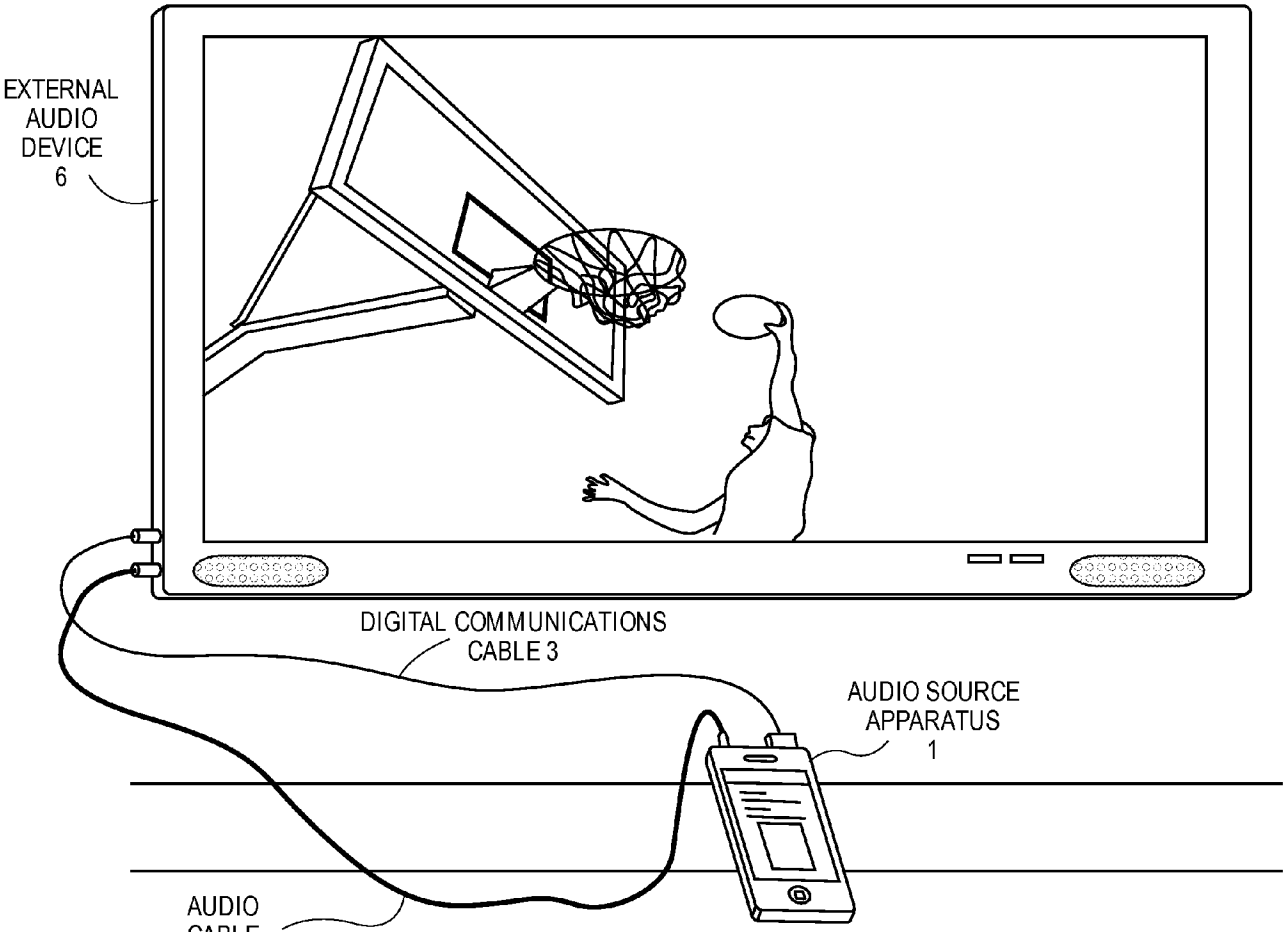
FIG. 2A illustrates another audio system having two components that are connected to each other by an audio cable and by another cable.
Figure 2B:
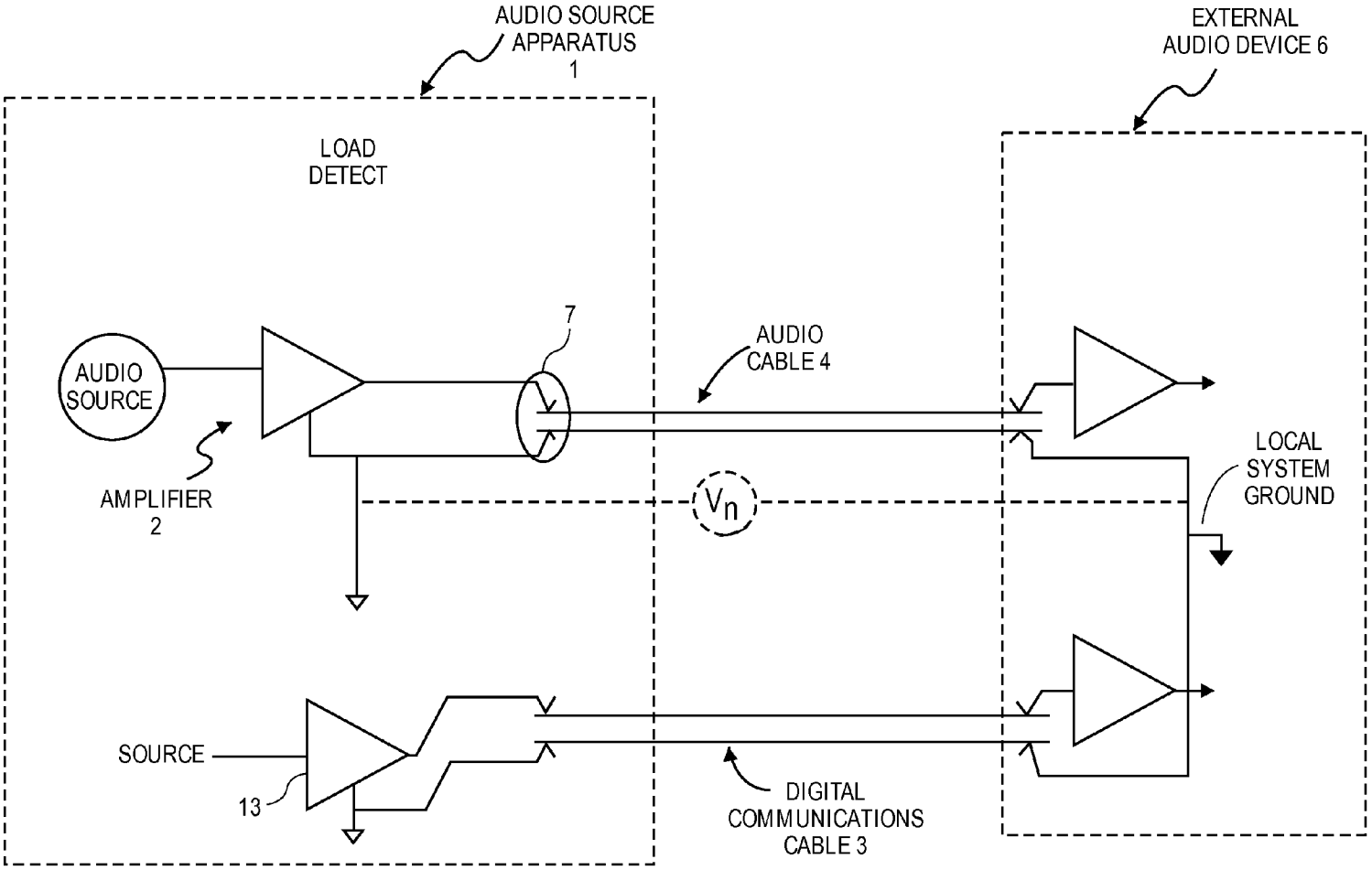
FIG. 2B is a combined circuit schematic and block diagram of the system of FIG. 2A in relevant parts thereof, in order to illustrate a ground loop.

A similar ground loop interference problem is created in the embodiment of FIG. 2A, where the audio source apparatus 1 need not be connected to an ac wall outlet. In that case, the audio source apparatus 1 is connected to the external audio device 6 by not just the audio cable 4, but also by a digital communications cable 3. This scenario may also lead to a ground loop and the associated ground loop interference voltage Vn being created, as depicted in the schematic diagram FIG. 2B.

Figure 4:
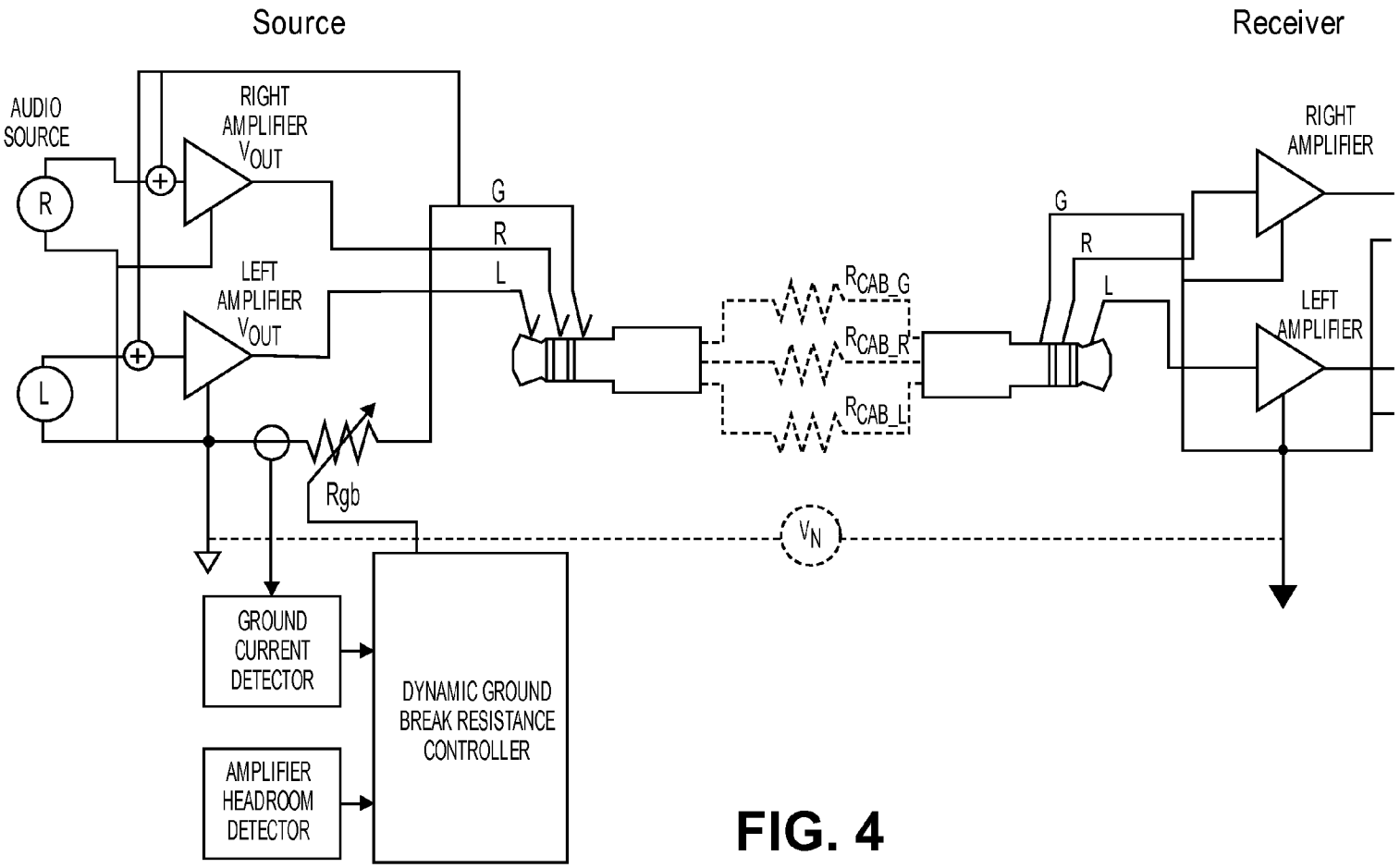
FIG. 4 is a combined block diagram and circuit schematic of relevant portions of an audio source apparatus that has an amplifier headroom detector to control an adjustable ground break resistance.

Turning now to FIG. 4, this is a combined circuit schematic and block diagram of an audio system having an audio source apparatus, in accordance with an embodiment of the invention. The source apparatus has an audio amplifier (left amplifier or right amplifier) having a first input coupled to the audio source, a second input coupled to a return pin G of a connector, and an output that is coupled to the signal out pin (R or L) of the connector. The audio amplifier has a ground reference node that is coupled to the ground plane (local system ground) of the apparatus. A variable resistor circuit is coupled to provide variable ground break resistance Rgb, between the return pin of the connector and the ground plane of the apparatus. In one embodiment, the variable resistor circuit has a node that is dc coupled to the return pin of the connector and another node that is dc coupled to the ground plane. An amplifier headroom detector detects headroom of the L or R audio amplifier. A dynamic ground break resistance controller has an input coupled to an output of the headroom detector.

The controller may be activated when an audio application is running in the audio source apparatus, and/or when there is detection of an external load being attached to the connector. The controller may be implemented as a programmed digital processor in combination with hardwired circuitry, and may be implemented in a distributed fashion, e.g. a portion of it may be implemented as part of an audio codec chip while another portion may be implemented by a suitably programmed applications processor, central processing unit, CPU, or system on a chip, SoC. The controller is coupled to control the variable resistor circuit, in response to the headroom detection.

Also shown in FIG. 4 is a modeling voltage source Vn, which models the ground loop interference that produces an audible interference signal in the audio range. The voltage Vn is developed across the small but finite resistance Rcab_G of the audio cable 4, and may be heard as noise through the speaker (not shown) that is driven by the L or R amplifier of the receiver apparatus.

Figure 5:
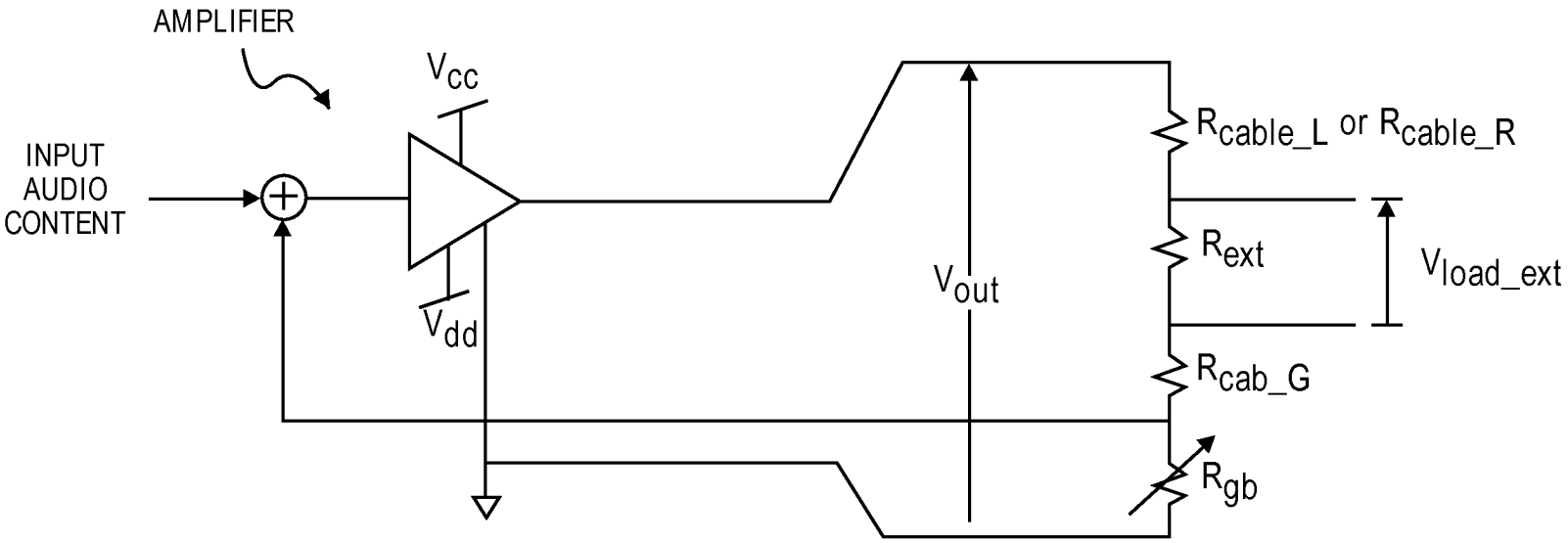
FIG. 5 is a combined block diagram and circuit schematic of an amplifier in an audio source apparatus that is connected to an external load and the adjustable ground break resistance.

FIG. 5 is a circuit schematic of the source apparatus' amplifier and its complete load, across which the amplifier's output voltage Vout is developed. The complete load is modeled by a resistor ladder composed of a series connection of the following: Rcab_G (includes the finite resistance of the return signal path through the audio cable 4); Rcab_L or Rcab_R (depending on which audio channel is being considered); Rext (in FIG. 4, this is the input impedance of a left amplifier or a right amplifier that is inside the receiver apparatus); and Rgb, the variable ground break resistance. Note that Rext will be quite different, varying by at least an order of magnitude, depending on the type of external load that is connected. For example, in the case of an unpowered headset, Rext may be for example in the range of 15 ohms to several hundred ohms, while for a receiver line-in Rext may be in the range of 10 kohms to 50 kohms.

FIG. 5 can also be used to illustrate an advantageous effect on a user's experience of the audio system, obtained by connecting a feedback voltage from the node that is between Rgb and Rcab_G. A summing junction at the input of the amplifier receives both the input audio content signal and the feedback signal. With this arrangement, for a given sound volume setting received from a user interface of the source audio apparatus (not shown), which is equivalent to a corresponding magnitude of the input audio content signal at the summing junction input, the audio amplifier responds by producing its output signal with a magnitude that varies in such a way that a constant magnitude audio signal will result across the external load Rext, despite changes in the variable resistance Rgb. In other words, for a constant magnitude audio signal (input audio content), the feedback will cause the amplifier to produce an output signal whose magnitude varies so that a constant magnitude audio signal is produced across the external load despite changes in the variable resistance. This means that the controller (see FIG. 4) can change the ground break resistance Rgb in real-time or dynamically, or in other words automatically during in-the-field use of the audio source apparatus by an end user, without affecting the loudness produced by the receiver (and its connected speaker). Viewed another way, the voltage feedback allows the voltage gain between the signal across the external load Rext and the input audio content signal to remain constant, despite the changing ground break resistance Rgb. One example of this voltage feedback topology is shown in FIG. 7, in which the amplifier includes an operational amplifier (op amp) configured as a summing-type, closed loop (negative feedback) amplifier. An input to a summing circuit has Rin at the non-inverting input of the op amp, which is dc coupled to the ground plane of the audio apparatus through Rf as shown. The input to the summing circuit is coupled to the signal return pin of the audio cable connector, which is also coupled to the local system ground plane through Rgb. Another input of the summing circuit is coupled, through another Rin, to the audio source. The voltage gain is by set based on the ratio Rf/Rin. Note however that other more complex linear amplifier designs, including ones having different summing-type inputs and feedback circuit designs, are possible, as well as switching type or Class D amplifiers.

Figure 6:
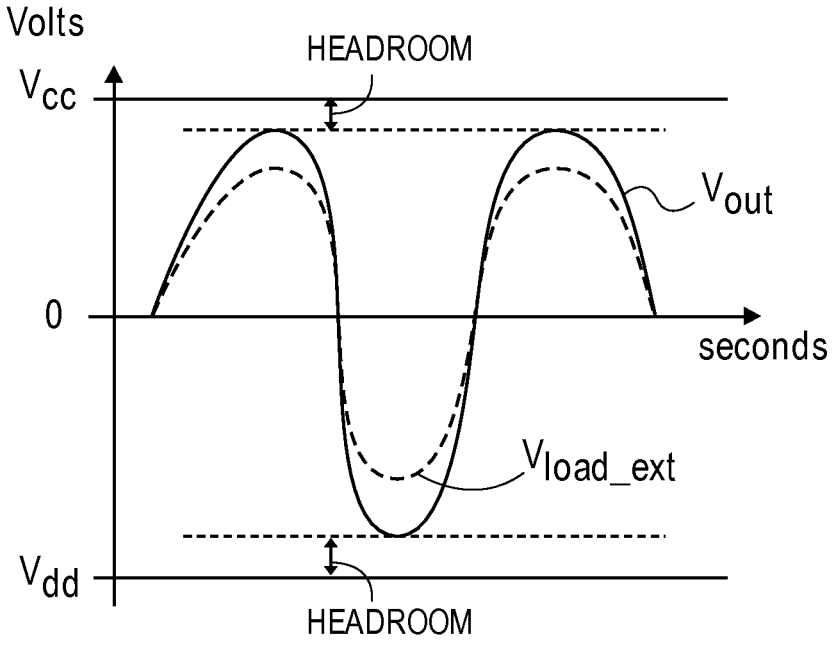
FIG. 6 illustrates amplifier headroom using example amplifier output and load voltage waveforms.

The advantageous result obtained by the use of the above-described voltage feedback arrangement, however, may be spoiled when making Rgb too large. To explain, recall that making Rgb larger will reduce the interference current through Rcab_G. However, an increase in Rgb will also, due to the voltage feedback described above, lead to the amplifier automatically increasing its Vout signal swing, in order to maintain the same voltage Vload_ext across the external load. In other words, as Rgb increases, more of the Vout signal swing is dropped across Rgb, such that to maintain the same Vload_ext (drop across Rext), the signal swing of Vout will have to increase. Referring now to FIG. 6, example waveforms depicting the behavior of Vout and Vload_ext are shown, relative to the power supply rail voltages Vcc and Vdd of the amplifier. The concept of headroom is also defined here, in this case as the delta voltage between Vout and that of one of the power supply rails. It can be seen that as the signal swing of Vout increases (because of Rgb being made larger) the headroom shrinks, and if this continues enough then the amplifier may start to behave nonlinearly, abnormally, or in an unstable manner, thereby distorting Vload_ext. When that happens, the output of the speaker that is being driven by the receiver amplifier (see FIG. 4) will also become distorted. If Rgb is made sufficiently large, the amplifier output voltage Vout will start to be clipped, thereby producing further audible distortion. Thus, a point is reached when the amplifier output is close to run running out of headroom, at which point Rgb should not be increased any further (despite the desire to reduce ground loop interference current in Rcab_G).

An embodiment of the invention uses a headroom detector that determines the present output headroom of the audio amplifier. The headroom may be viewed as a delta voltage, being a difference between a) maximum excursion or peak of the output voltage of the amplifier, while user audio content or test content is input to the amplifier, and b) a power supply voltage of the amplifier. This is shown in FIG. 6. Alternatively, headroom may be defined as a ratio of maximum Vout excursion to power supply voltage. The headroom may also be a normalized value.

However a headroom value is defined, the headroom detector may use any one of the following techniques to sense or compute a measure of the headroom. In one embodiment, a feed forward (or look ahead) type of computation is performed, by digitally analyzing the peaks of the digital audio input signal produced by the audio source, which is being converted into analog form or other wise driven by the amplifier out through the audio cable 4 (and into the external load). This analysis of the digital audio input signal may be performed in conjunction with knowledge of 1) a stored characteristic or behavioral model of the amplifier, 2) the expected total load impedance (including Rcable_L or Rcable_R, Rext, and the present value of the variable ground break resistance Rgb) which may be a stored value, and 3) a stored value representing the amplifier's power supply rail voltage.

In another embodiment, the headroom detector and the controller may behave reactively, where the headroom detector includes a circuit that senses the present output voltage of the amplifier, Vout (Vout_left or Vout_right), and optionally also senses the present power supply rail voltage, Vcc or Vdd. The power supply rail voltage here may, alternatively, be taken as a known, regulated value, and be found as a stored expected value. A comparison is then made between a) the sensed Vout and b) the expected or sensed power supply rail voltage, Vcc or Vdd, and the results of such a comparison are signaled to the controller, e.g. as a difference or delta value.

Once a measure of headroom has been determined, the controller then compares the determined headroom to a set threshold, which may represent the minimum headroom that can be tolerated. When the headroom has shrunk down to the threshold, the controller responds by appropriately controlling the variable resistor circuit. If the determined headroom has shrunk down to a predetermined threshold or guard band (see FIG. 6), due to Rgb having increased, then the controller may signal that Rgb cannot be made larger, which encompasses for example signaling a certain amount of decrease in Rgb, because the headroom is now too small and could cause distortion in the amplifier output signal. Decreasing Rgb in this manner will help increase the headroom.

In yet another embodiment, the headroom detector may be a circuit that is built into the audio amplifier, e.g. as part of a constituent operational amplifier, that automatically asserts a headroom alert signal when an internal state of the op amp (e.g., certain node voltages) indicates that for example the op amp is no longer operating in a stable feedback configuration (which may mean that the output voltage of the op amp has likely risen so much as to be too close to its power supply rail voltage). In that case, the controller may not need to perform any comparison and can simply rely on the low headroom alert signal from the headroom detector, to immediately decide how to adjust downward or place an upper limit to the value of Rgb (by appropriately signaling the variable resistor circuit).

The controller may also signal the variable resistor circuit to increase Rgb, as follows. In one embodiment, the controller performs digital signal processing upon the audio input signal from the audio source (prior to amplification), or if available the amplifier output Vout, to determine when Rgb can be allowed to increase. Such processing may include any combination of signal level based dynamics such as attack and release times and hysteresis, and time based dynamics such as hold times. In another embodiment, once Rgb has reached an "optimum" level, Rgb may not be increased until the next time attachment of the connector has been detected. In that case, the controller can be configured to perform a conventional connector attachment/detachment detection process.

The controller may also signal the variable resistor circuit to decrease Rgb, as follows. The total amplifier load impedance may be detected using any conventional scheme; for smaller total load impedances, a smaller Rgb should be used (with the understanding that Rgb will in most cases be smaller than the external load impedance). The slope of the amplifier output voltage, or the slope of the amplifier input voltage, dV/dt, may be detected, and on that basis Rgb may be decreased. This process may be performed in real-time, by allowing a margin, favoring an "early" reduction in Rgb and then increasing Rgb based on the detected slope. Alternatively, if a digital form of the amplifier input signal (audio user content, or test content) or amplifier output signal is available, the controller can perform a digital signal processing-based look ahead scheme to compute the slope.

In one embodiment, the controller adapts the ground break resistance to different types of amplifier loads (based on the headroom detection described above), by adjusting the variable resistor circuit accordingly so that the ground break resistance is kept as large as possible to alleviate ground loop interference but without becoming so large as to cause output signal swing of the amplifier to become distorted (due to coming too close to the power supply voltage). The variation in amplifier load may be due to different line-in or receiver input impedance, different passive speaker input impedance, different types or lengths of audio cables, and different connector contact resistance (e.g., as the source audio apparatus ages).

In one embodiment, the variable resistor circuit may have two or more discrete resistance states, obtained by for example a configurable discrete passive resistor network. In another embodiment, the variable resistor circuit may exhibit continuously variable resistance, e.g. using a transistor such as an insulated gate field effect transistor whose Vgs is variable, or other types of transistors and active devices that can present a variable resistance in the desired range. In yet another embodiment, a switched capacitor network or a rapidly switched (well beyond the audio range) resistor may be used to emulate the desired variable resistance. A combination of the above may be used to obtain the variable resistance. In all such cases, the variable resistance may be digitally controllable, by the controller, e.g. from essentially zero ohms (which may be used when a passive headphone has been connected), to one or more non-zero resistance values (which may be used when the amplifier is connected to an audio receiver or line input). The controller may have a stored lookup table of headroom values and associated variable resistor circuit settings, which may be accessed by the controller whenever a new headroom value has been determined (in order to update the variable resistor circuit setting).

Returning to FIG. 4, this figure shows yet another embodiment of the invention, where the source audio apparatus in this case further includes a ground current detector that is coupled to detect ground current through the variable resistor circuit. In this embodiment, the controller has a further input that is coupled to an output of the ground current detector, which the controller uses to determine when the detected ground current crosses a zero threshold. The controller in a sense looks for a zero current crossing, and synchronizes an adjustment made to the variable resistor circuit with the zero current crossing. This may help avoid user-audible artifacts, sometimes referred to as pops and clicks, while the variable resistor is being changed dynamically (or in real-time during in-the-field use of the source apparatus by an end user) and the external load remains connected to the output of the amplifier. The ground current detector may use a current sense resistor technique where the voltage across a current sense resistor (not shown) that is in series with variable resistor circuit is sensed, in order to yield the sensed current. Alternatively, the current sense resistor technique may sense the voltage across the ground break resistance of the variable resistor circuit, which may be considered a known value. As yet another alternative of the current sense resistor technique, the voltage may be sensed across an analog switch network (a switch resistance measurement). In yet another embodiment, the ground current detector may use a different mechanism such as current mirroring, inductive sensing, or hall effect sensing, to obtain a voltage that representing the ground current.

The concern with the occurrence of user-audible artifacts when changing the ground break resistance may also be addressed by designing the variable resistor circuit to have sufficient granularity or resolution in its variable resistance, such that the controller can change the ground break resistance in smaller increments. This may give the amplifier enough time to adjust its output voltage gradually (in response to the feedback voltage from the Rgb node changing more gradually). This technique could be used as an alternative to relying on the ground current zero crossing detection scheme, or it could be used in conjunction therewith when updating the decision to change the ground break resistance.

In the case where the controller computes an estimate of the load impedance of the amplifier, there may be a need for sensing the load current. In that case, the sensed ground current (by the ground current detector) may be used, as representing the current through a circuit path that dc couples the ground plane of the source apparatus to the return pin of the connector, through the variable resistor circuit. The controller thus obtains or computes a measure of load current of the amplifier, based on the sensed ground current, and then uses it to compute the estimate of the load impedance (e.g., together with a measure of the amplifier output voltage). This may be done for frequency components that are below the audible frequency range.

An embodiment of the invention is a method for audio signal processing, in which an audio amplifier is driving an external load through a connector. While doing so, the amplifier is configured to respond to an input audio signal (e.g., a test signal or user audio content), and a signal from a return pin of the connector (which return pin is dc coupled to a ground plane). The method includes detecting output headroom of the amplifier (while the amplifier is driving the load). A variable resistor circuit that is coupled to provide variable resistance between the return pin of the connector and the ground plane is then automatically adjusted, i.e. without user input, in response to the detected output headroom of the amplifier. The amplifier is configured with feedback, such that when the input audio signal has fixed amplitude, the amplifier produces a voltage across the external load that also has fixed amplitude, despite changes in the variable resistance. In other words, the effective voltage gain to the external load remains fixed despite the dynamically changing ground break resistance.

In one embodiment, detecting output headroom of the audio amplifier comprises analyzing 1) a peak of the input audio signal, 2) a characteristic or behavioral model of the amplifier, 3) the amplifier's load impedance, and 4) the amplifier's power supply rail. In another embodiment, detecting output headroom of the audio amplifier comprises sensing output voltage of the amplifier, and comparing the sensed output voltage to a sensed or known value representing voltage of the amplifier's power supply rail. Based on the detected output headroom being smaller than a threshold, an indication is given that the variable resistance cannot be made larger or the variable resistance is simply lowered.

Figure 8:
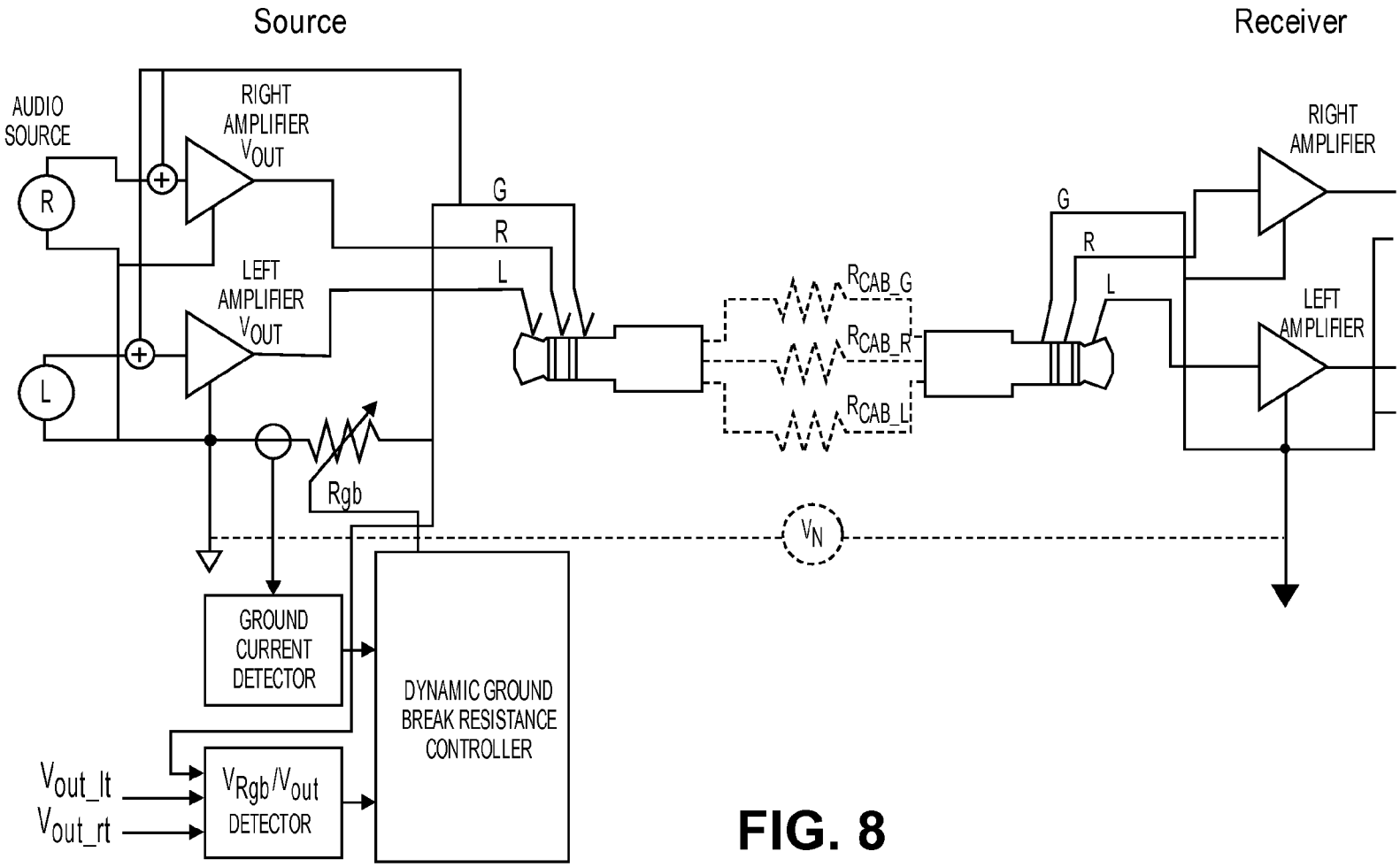
FIG. 8 is a combined block diagram and circuit schematic of relevant portions of an audio source and an audio receiver, with a detector that compares amplifier output voltage with voltage of a node of the variable ground break resistor circuit.

Turning now to FIG. 8, this is a combined block diagram and circuit schematic of an audio system in which a different mechanism is used to control the variable ground break resistance. The system may be similar to one described above, in the following aspects: an audio source apparatus has an audio source, a connector having at least one signal out pin (R or L) and a return pin (G); the variable resistor circuit has a first node and a second node between which it provides variable ground break resistance Rgb, where the first node is coupled to the return pin of the connector and the second node is coupled to a local system ground or ground plane of the source apparatus; the audio amplifier has a first input to receive an audio signal from an audio source (R channel or L channel), a second input coupled to the return pin (G) of the connector, and an output that is coupled to the signal out pin (R or L) of the connector. The optional ground current detector may also be used in this embodiment, where the controller in that case signals the variable resistor to change its variable resistance based on window of time during which the detected ground current is expected to cross a zero threshold.

The system in FIG. 8 also differs from the embodiment of FIG. 4 in that the dynamic ground break resistance controller's decisions on Rgb are now based (at least in part) on the output of a different type of detector, namely one that compares voltage of the output of the audio amplifier, Vout, with voltage of the first node of the variable resistor circuit, VRgb. The controller is coupled to control the variable resistor circuit in response to the detector's comparison. This comparison may be in the form of a digital computation of a ratio of the two sensed voltages, e.g. VRgb/Vout. The controller responds to this comparison, by, for example, preventing any further increase in the variable resistance, which may include signaling an actual decrease in the variable resistance, when the detector's comparison indicates that the ratio VRgb/Vout, representing voltage of the first node of the variable resistor circuit relative to the amplifier output voltage, has exceeded a threshold. To explain via an example, when the voltage across Rgb has increased to a predetermined threshold, e.g. given as some percentage X of the present amplifier output swing, e.g. the latter being given as an rms voltage value, then Rgb should not be made any larger. In other words, the controller continues to increase the resistance of Rgb but not beyond a value that causes more than X % of the total amplifier output voltage to appear across Rgb.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although the figures depict an audio system having two channels, namely a left channel and a right channel, the concepts described above are applicable more generally to audio systems having a single output channel or more than two output channels, and also those having both output and input (e.g., microphone or sound pick up) channels. The description is thus to be regarded as illustrative instead of limiting.

What is claimed is:

1. An audio apparatus comprising:

an audio source;

a connector having a signal out pin and a return pin to be coupled to an external load;

a variable resistor circuit coupled to provide variable resistance between the return pin of the connector and a ground plane of the apparatus;

an audio amplifier having a first input coupled to the audio source, a second input coupled to the return pin of the connector, and an output that is coupled to the signal out pin of the connector;

an amplifier headroom detector to detect a measure of headroom of the audio amplifier, wherein headroom is a difference or ratio between (i) peak output voltage of the amplifier and (ii) a power supply voltage of the amplifier; and a controller having an input coupled to an output of the headroom detector, the controller being to coupled to control the variable resistor circuit in response to the detected measure of headroom.

2. The audio apparatus of claim 1 wherein for a given sound volume setting received from a user interface, the audio amplifier responds to a constant magnitude audio signal, by producing an output signal whose magnitude varies so that a constant magnitude audio signal is produced across the external load despite changes in the variable resistance.

3. The audio apparatus of claim 1 wherein the amplifier comprises:

a summing circuit having first and second inputs that are coupled to receive the signals from the audio source and the return pin, respectively; and an operational amplifier whose inputs are coupled to the summing circuit and is configured for closed loop amplification.

4. The audio apparatus of claim 1 further comprising a ground current detector coupled to detect ground current through the variable resistor circuit, wherein the controller has a further input coupled to an output of the detector and is to determine when the detected ground current crosses a zero threshold.

5. The audio apparatus of claim 1 further comprising a ground current detector that is coupled to sense ground current through a circuit path that dc couples the ground plane of the apparatus to the return pin through the variable resistor circuit, wherein the controller is to compute a measure of load current of the amplifier based on the sensed ground current.

6. The audio apparatus of claim 1 wherein the headroom detector computes a measure of headroom by analyzing 1) peaks of a digital audio input signal from the audio source, 2) a characteristic or behavioral model of the amplifier, 3) a value representing amplifier load impedance, and 4) a value representing power supply voltage of the amplifier.

7. The audio apparatus of claim 1 wherein the headroom detector senses output voltage of the amplifier and compares the sensed output voltage to a measure of power supply rail voltage of the amplifier.

8. The audio apparatus of claim 1 wherein the controller, based on the detected measure of headroom, signals that the variable resistance cannot be made larger or signals that the variable resistance be decreased.

9. The audio apparatus of claim 1 wherein the headroom detector comprises a circuit that is built into the amplifier and that automatically asserts a low headroom alert signal, based on an internal state of the amplifier, and the controller responds to the low headroom alert signal by signaling that the variable resistance cannot be made larger or signals that the variable resistance be decreased.

10. A method for audio signal processing, comprising:

driving, by an audio amplifier, a load through a connector, using 1) an input audio signal, and 2) a signal from a return pin of a connector to which the amplifier is coupled for driving the load;

detecting a measure of output headroom of the audio amplifier while the amplifier is driving the load, wherein headroom is a difference or ratio between (i) peak output voltage of the amplifier and (ii) a power supply voltage of the amplifier; and automatically adjusting a variable resistor circuit that is coupled to provide variable resistance between the return pin of the connector and a ground plane, in response to the detected measure of output headroom of the amplifier.

11. The method of claim 10 wherein when the input audio signal has fixed amplitude, the amplifier produces a voltage across the load that also has fixed amplitude, despite changes in the variable resistance.

12. The method of claim 10 further comprising detecting ground current through the variable resistor circuit, and looking for a zero current crossing by the detected ground current, based on which the variable resistor circuit is adjusted.

13. The method of claim 10 wherein detecting a measure of output headroom of the audio amplifier comprises:

analyzing 1) a peak of the input audio signal, 2) a characteristic or behavioral model of the amplifier, 3) the amplifier's load impedance, and 4) power supply rail voltage of the amplifier.

14. The method of claim 10 wherein detecting a measure of output headroom of the audio amplifier comprises sensing output voltage of the amplifier, the method further comprising comparing the sensed output voltage to a value representing voltage of the amplifier's power supply rail.

15. The method of claim 10 further comprising:

signaling that the variable resistance cannot be made larger, based on the detected measure of output headroom being a value that is smaller than a threshold.

16. The method of claim 10 further comprising:

lowering the variable resistance, based on the detected measure of output headroom being a value that is smaller than a threshold.

17. An audio apparatus comprising:

an audio source;

a connector having a signal out pin and a return pin;

a variable resistor circuit having a first node and a second node between which it provides variable resistance, the first node being directly coupled to the return pin of the connector and the second node being directly coupled to a ground plane of the apparatus;

an audio amplifier having a first input to receive an audio signal, a second input directly coupled to the return pin of the connector, and an output that is coupled to the signal out pin of the connector;

a detector to compare voltage of the output of the audio amplifier with voltage of the first node of the variable resistor circuit;

a controller coupled to control the variable resistor circuit in response to the detector's comparison; and a ground current detector coupled to detect ground current through the variable resistor circuit, wherein the controller is to signal the variable resistor circuit to change said variable resistance when the detected ground current crosses a zero threshold.

18. The audio apparatus of claim 17 wherein the controller no longer increases the variable resistance when the detector's comparison indicates that the voltage of the first node of the variable resistor circuit relative to the amplifier output voltage has exceeded a threshold.

19. The audio apparatus of claim 17 wherein the controller signals the variable resistor circuit to lower the variable resistance, based on the detector's comparison indicating that the voltage of the first node of the variable resistor circuit relative to the amplifier output voltage has exceeded a threshold.

20. The audio apparatus of claim 17 wherein the controller signals that the variable resistance not be made larger, based on the detector's comparison indicating that the voltage of the first node of the variable resistor circuit relative to the amplifier output voltage has exceeded a threshold.

* * * * *